US006196243B1

(12) United States Patent
Chen

(10) Patent No.: US 6,196,243 B1
(45) Date of Patent: Mar. 6, 2001

(54) AUTOMATIC UMBRELLA CONTROL MECHANISM

(75) Inventor: Tien-Cheng Chen, Changhua Hsien (TW)

(73) Assignee: Ming Ho Umbrella Industry Co., Ltd., Chunghua Hsien (TW)

( * ) Notice: Subject to any disclaimer, the term of this patent is extended or adjusted under 35 U.S.C. 154(b) by 0 days.

(21) Appl. No.: 09/419,286

(22) Filed: Oct. 15, 1999

(51) Int. Cl.[7] ..... A45B 25/14
(52) U.S. Cl. ..... 135/22; 135/20.3; 135/24
(58) Field of Search ..... 135/22, 20.3, 24, 135/25.4

(56) References Cited

U.S. PATENT DOCUMENTS 4,989,625 * 2/1991 Wu ..... 135/22
5,390,686 * 2/1995 Lin et al. ..... 135/20.3
5,617,889 * 4/1997 Wu ..... 135/24
5,823,215 * 10/1998 Chou et al. ..... 135/22
5,992,433 * 11/1999 Chung-Kuang et al. ..... 135/20.3

* cited by examiner

*Primary Examiner*—Anthony D. Barfield
(74) *Attorney, Agent, or Firm*—Bacon & Thomas, PLLC

(57) ABSTRACT

An automatic umbrella control mechanism, which includes a socket defining a receiving chamber, a receptacle supported on a compression spring in the receiving chamber inside the socket, a hook turned about a pivot in the socket and supported on a torsional spring at the pivot, a button controlled to turn the hook for enabling the folding collapsible umbrella frame to be opened by a return spring, and a retainer bit to be retained to secured in position by a pressure spring to hold the umbrella in the open position. When the button is depressed again, the retainer bit is released from the constraint, enabling the umbrella to be collapsed by means of the operation of the return spring.

2 Claims, 5 Drawing Sheets

AUTOMATIC UMBRELLA CONTROL MECHANISM

BACKGROUND OF THE INVENTION

The present invention relates to an automatic umbrella, and more specifically to an automatic umbrella control mechanism for controlling opening/closing of the umbrella by a common button.

A conventional umbrella must be opened manually with both hands. Recently, a variety of semi-automatic umbrellas have been disclosed, and have appeared on the market. These semi-automatic umbrellas commonly use spring means controlled by a button to release the folding collapsible umbrella frame from the constraint. However, these semi-automatic umbrellas must be closed manually with both hands when not in use.

SUMMARY OF THE INVENTION

It is the main object of the present invention to provide an automatic umbrella control mechanism, which enables the user to open and close the umbrella automatically by means of operating a common button. According to the present invention, the automatic umbrella control mechanism comprises a socket, the socket comprising a receiving chamber, a longitudinal sliding groove inside the receiving chamber, a transverse pivot disposed inside the receiving chamber at a top side, a hook turned about the transverse pivot, a torsional spring mounted on the transverse pivot and connected to the hook to force the hook in one direction, a compression spring mounted in the receiving chamber inside the socket, a receptacle supported on the compression spring inside the socket, the receptacle comprising a tubular bottom flange coupled to the compression spring, a rib coupled to the longitudinal sliding groove inside the socket to guide vertical movement of the receptacle in the socket, a pressure strip disposed at one side opposite to the rib, and a rectangular top notch corresponding to the pressure strip, and a button controlled to open/close the folding collapsible umbrella frame of the umbrella. When the button is depressed, the hook is tilted and released from the umbrella shaft for enabling the folding collapsible umbrella frame assembly to be opened by spring means. When the button is depressed again, a retainer bit is released, enabling the opened umbrella frame assembly to be collapsed by means of the operation of spring means in the umbrella shaft of the folding collapsible umbrella frame assembly.

DETAILED DESCRIPTION OF THE PREFERRED EMBODIMENT

Figure 1:
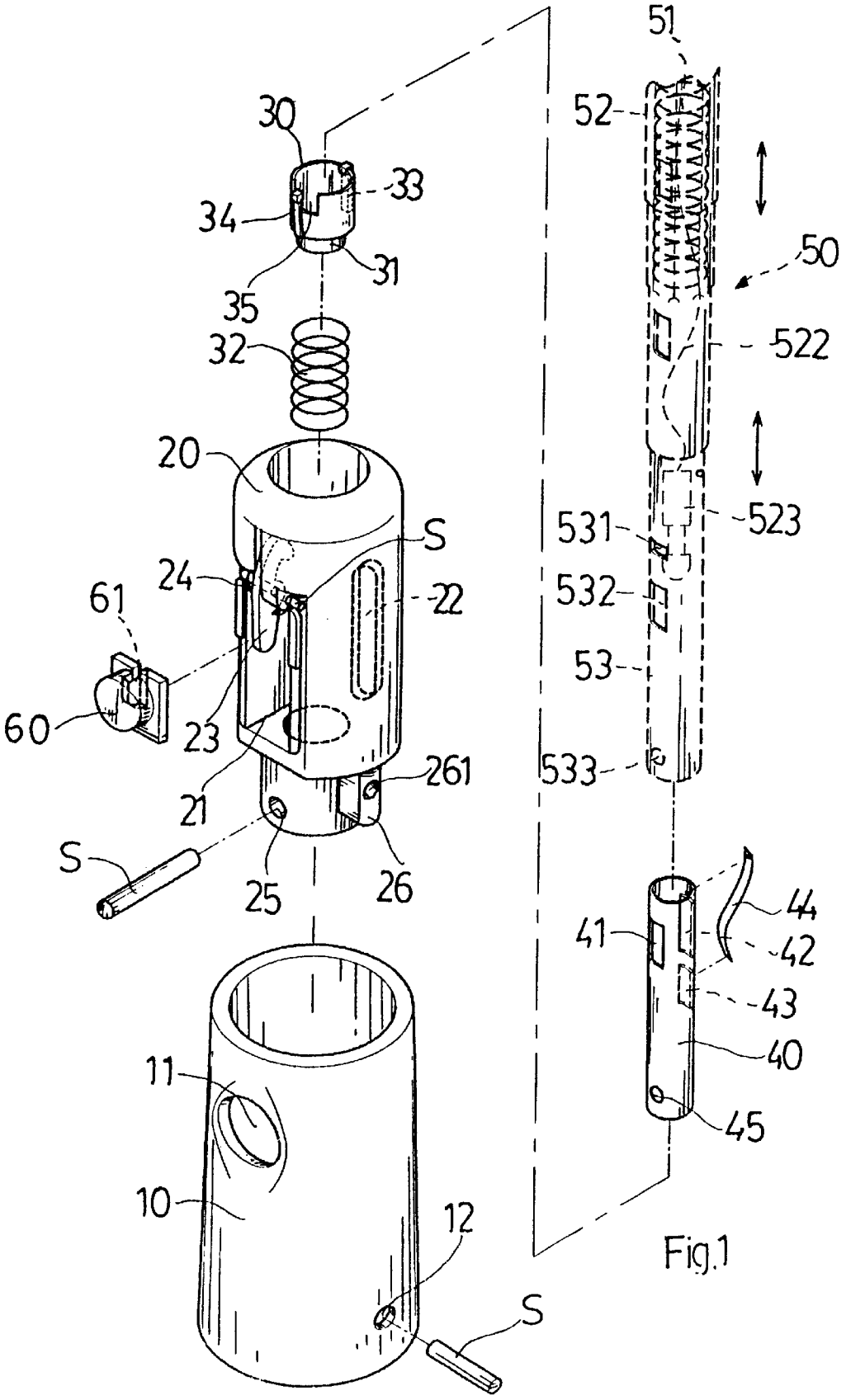
FIG. 1 is an exploded view of the present invention.

Referring to FIG. 1, an automatic umbrella control mechanism in accordance with the present invention is generally comprised of a hollow handle 10, a socket 20, a receptacle 30, a tube 40, an umbrella shaft 50, and a button 60.

The handle 10 comprises a round hole 11 through the peripheral wall near the top, and a pinhole 12 through the peripheral wall near the bottom. The socket 20 is mounted inside the handle 10, comprising a receiving chamber 21, a longitudinal sliding groove 22 inside the receiving chamber 21, a transverse pivot S disposed inside the receiving chamber 21 at the top, a hook 23 turned about the transverse pivot S, a torsional spring 24 mounted on the transverse pivot S and connected to the hook 23 to force the hook 23 in one direction, a first transverse pin hole 25 at the bottom end thereof, a side block 26 near the bottom end, and a second transverse pin hole 25 through the side block 26. The receptacle 30 is supported on a spring 32 inside the socket 20, comprising a tubular bottom flange 31 coupled to the compression spring 32, a rib 33 and a pressure strip 34 disposed at two opposite sides, and a rectangular top notch 35 corresponding to the pressure strip 34. The tube 40 is inserted through the receptacle 30 and the compression spring 32 inside the socket 20, comprising a side hole 41 near the top end thereof, two vertically spaced elongated holes 42 and 43 of different lengths disposed through the peripheral wall at one side opposite to the transverse side hole 41, a pressure spring 44 fastened to the elongated holes 42 and 43, and a transverse pin hole 45 near the bottom end thereof. The umbrella shaft 50 is inserted into the receptacle 20 and sleeved onto the tube 40 and fastened to the first pin hole 25 at the socket 20, comprised of an inner metal tube 53, and outer metal tube 52 sleeved onto the inner metal tube 53, a return spring 51 mounted inside the outer metal tube 52 and stopped above the inner metal tube 53, a pulley 521 mounted inside the outer metal tube 52, a pull cord 522 wound round the pulley 521, the pull cord 522 having a top end fixedly connected to the top end of the umbrella shaft 50 and a bottom end suspended in the umbrella shaft 50, and a retainer bit 523 suspended from the bottom end of the pull cord 522. The inner metal tube 53 comprises a transverse pin hole 533 near the bottom end thereof, a hook hole 531 spaced above the transverse pin hole 533 at one side, and an opening 532 spaced between the hook hole 531 and the transverse pin hole 533. The button 60 is mounted in the round hole 11 at the handle 10, comprising a groove 61 at an inner side corresponding to the hook 23 in the socket 20.

Figure 2:
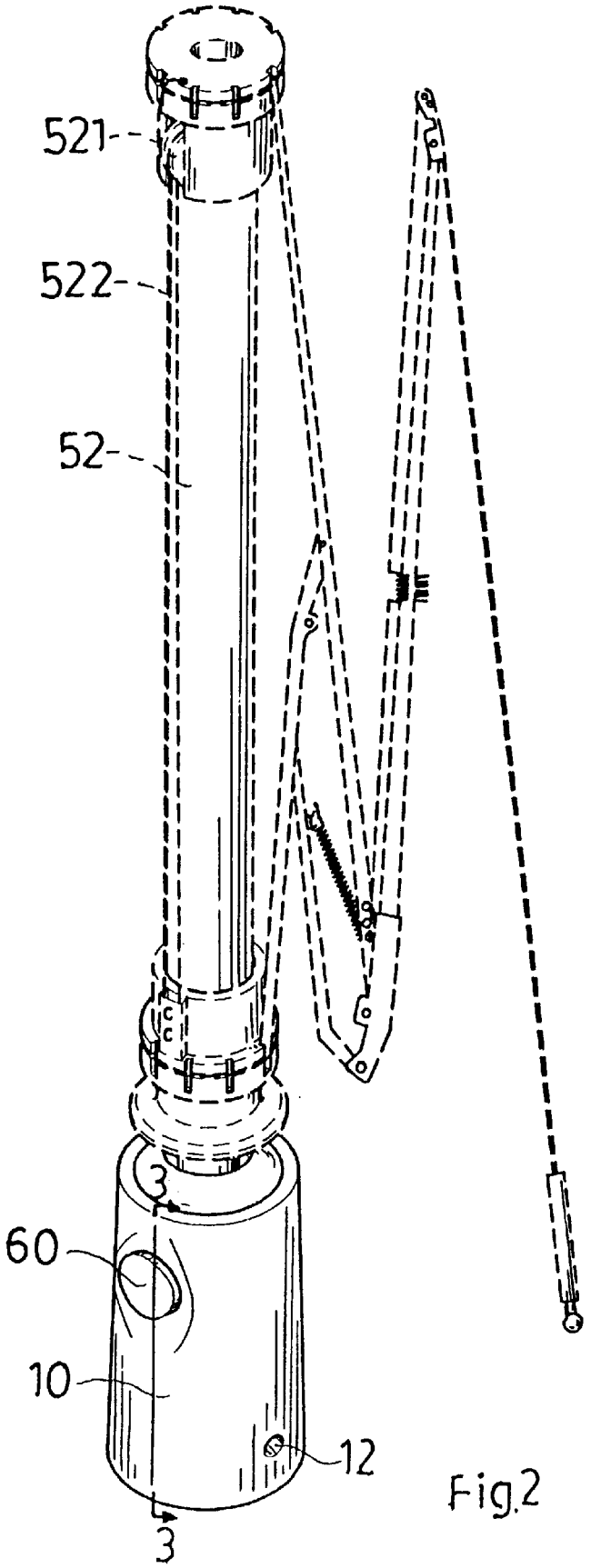
FIG. 2 is a perspective assembly view of the present invention.
Figure 3A:
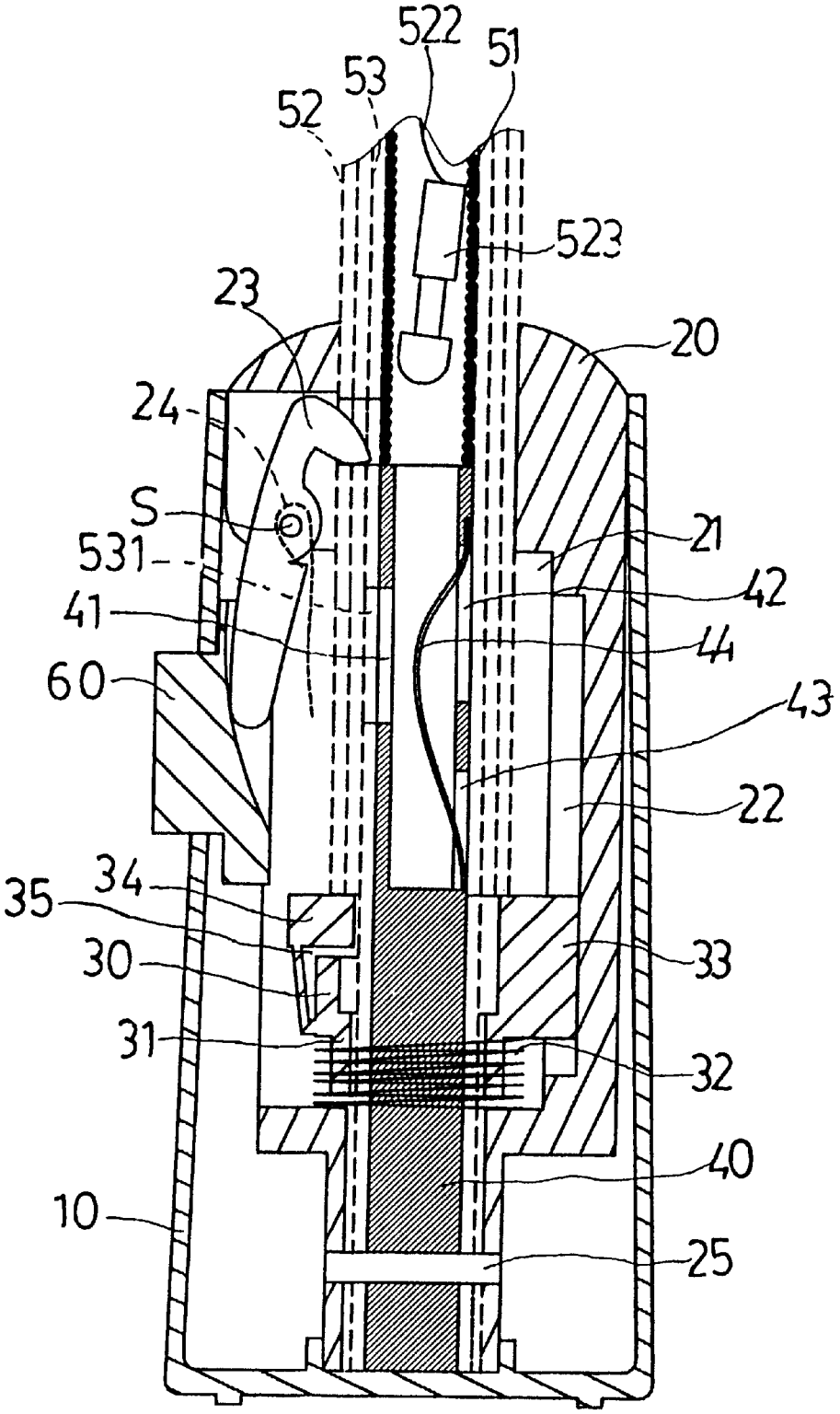
FIG. 3A is a sectional view taken along line 3—3 of FIG. 2.
Figure 3B:
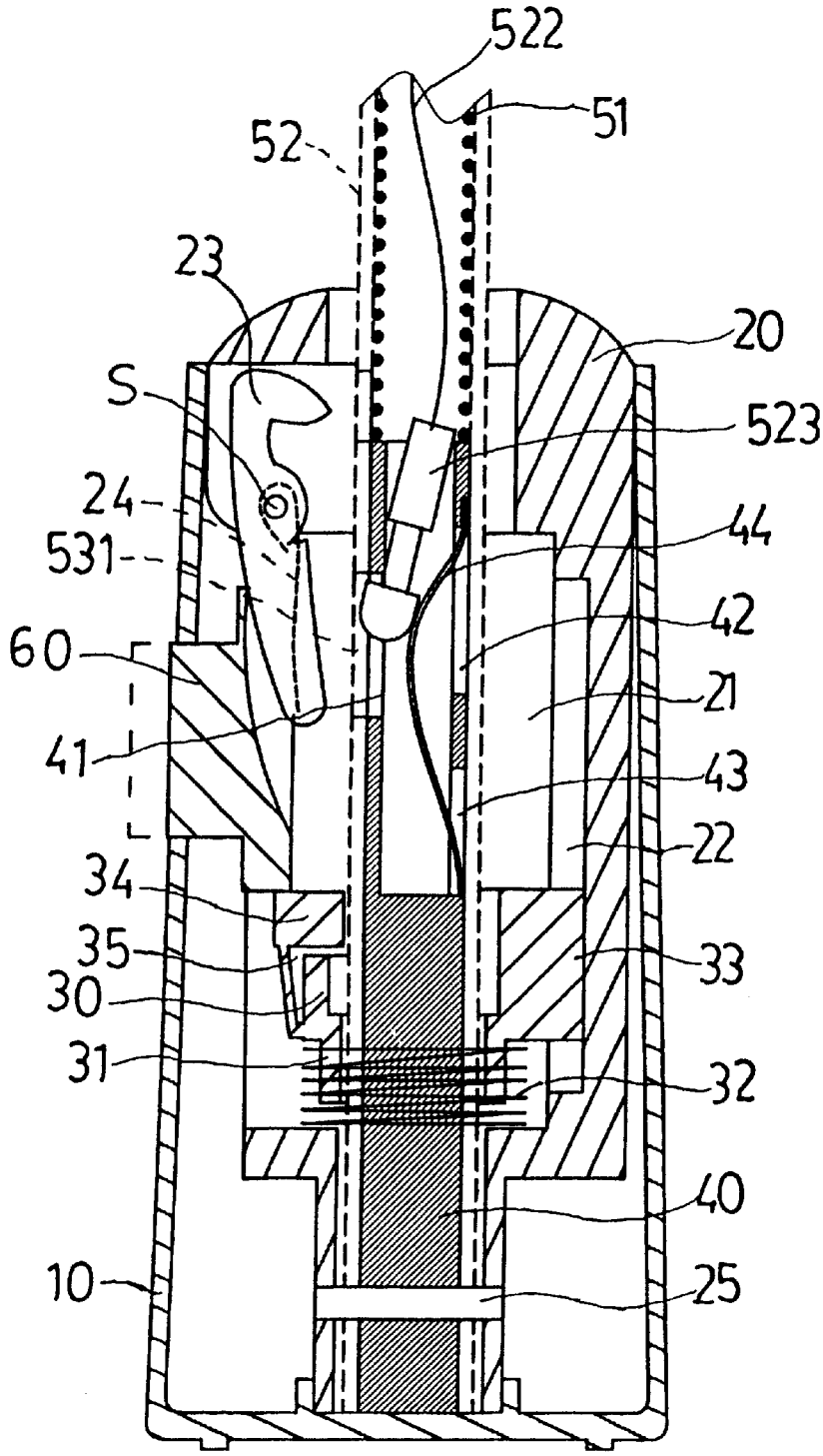
FIG. 3B is similar to FIG. 3A but showing the button depressed, the hook released from the umbrella shaft, the compression spring compressed, the retainer bit retained to the side hole at the tube.
Figure 3C:
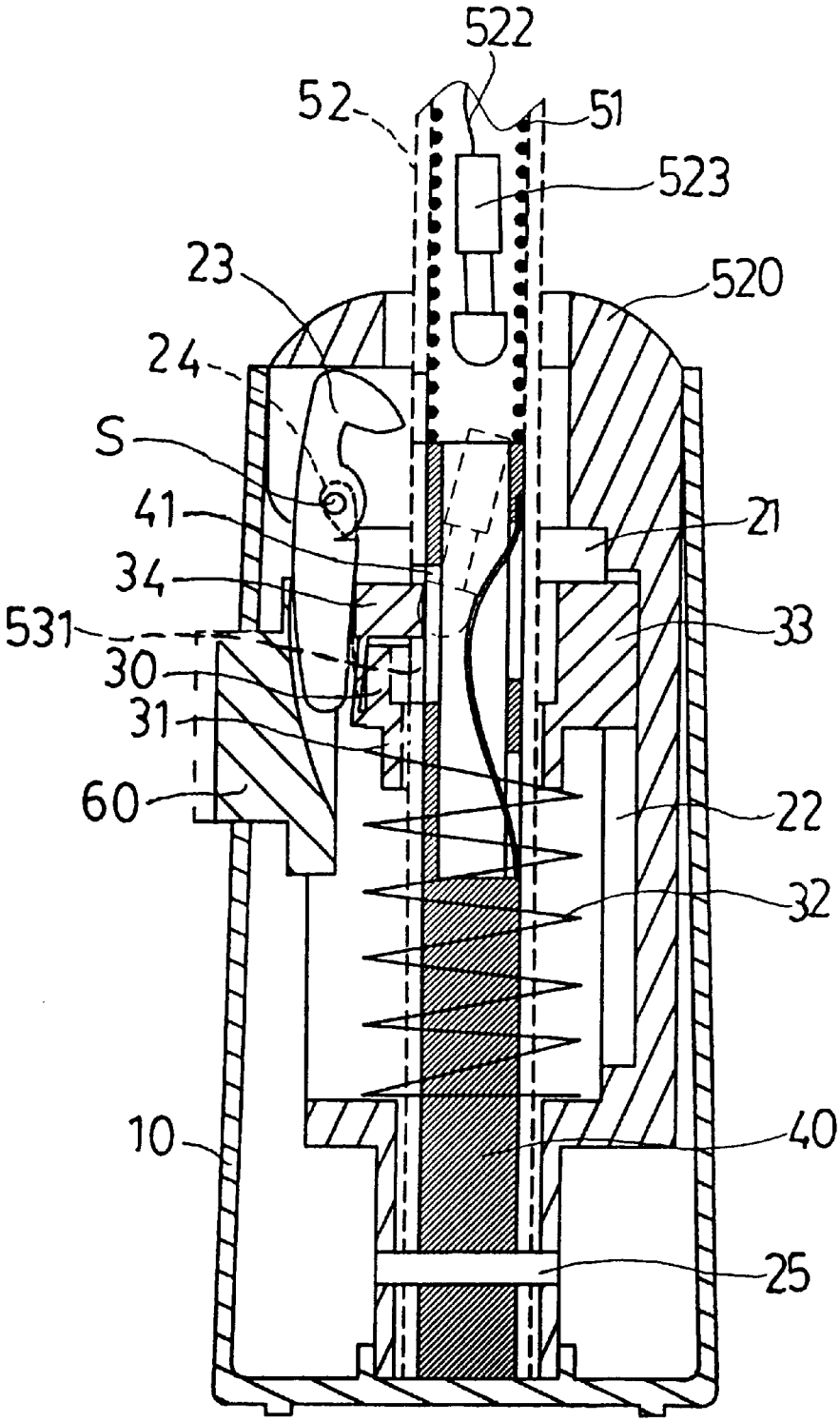
FIG. 3C is similar to FIG. 3B but showing the compression spring and the retainer bit released.

The assembly process of the present invention is outlined hereinafter with reference to FIG. 2. The receptacle 30 is supported on the spring 32 inside the socket 20 with the rib 33 coupled to the longitudinal sliding groove 22 inside the socket 20, then the sleeve 40 is inserted into the umbrella shaft 50, and then inserted with the umbrella shaft 50 through the receptacle 30 into the socket 20, and then a pivot S is fastened to the pin hole 45 at the tube 40, the pin hole 533 at the inner metal tube 53 and the pin hole 25 at the socket 20 to secure the tube 40, the umbrella shaft 50 and the socket 20 together, and then the socket 20 is inserted into the handle 10, and then a pivot S is fastened to the pin hole 12 at the handle 10 and the second pin hole 261 at the socket 20 to secure the socket 20 and the handle 10 together, and then the button 60 is mounted in the round hole 11 at the handle 10 with its groove 61 forced into engagement with the hook 23.

Referring to Figures from 3 through 5, when opening the umbrella, the button 60 is depressed to tilt the hook 23, causing the hook 23 to be disengaged from the hook hole 531 at the inner metal tube 53, and therefore the outer metal tube 52 is immediately pushed upwards by the return spring

52 to open the folding collapsible stretcher and rib assembly and the cover on the folding collapsible stretcher and rib assembly (not shown). When the outer metal tube 52 is pushed to the upper limit position, the retainer bit 523 is forced into the side hole 41 at the tube 40 and retained in place by the pressure spring 44, enabling the umbrella to be maintained in the open position, and at the same time the receptacle 30 is pushed upwards to its former position by the spring 32, keeping the pressure strip 34 in between the hook 24 in the socket 20 and the retainer bit 523 in the side hole 41 at the tube 40. When collapsing the umbrella, the button 60 is depressed again to force the hook 23 at the pressure strip 34 against the pressure spring 44, causing the pressure spring 523 to release the retainer bit 523, and therefore the umbrella shaft 50 is retracted by the return spring 51. When collapsed, the umbrella shaft 50 is forced downwards with hand, enabling the hook 23 to hook in the hook hole 513 at the inner metal tube 53 again.

What the invention claimed is:

1. An automatic umbrella control mechanism comprising:

a socket, said socket comprising a receiving chamber, a longitudinal sliding groove inside said receiving chamber, a transverse pivot disposed inside said receiving chamber at a top side, a hook turned about said transverse pivot, a torsional spring mounted on said transverse pivot and connected to said hook to force said hook in one direction;

a compression spring mounted in the receiving chamber inside said socket;

a receptacle supported on said compression spring inside said socket, said receptacle comprising a tubular bottom flange coupled to said compression spring; and a tube inserted through said receptacle and said compression spring inside said socket, said tube comprising a transverse side hole near a top end thereof, two vertically spaced elongated holes of different lengths disposed opposite to said transverse side hole, a pressure spring fastened to said elongated holes.

2. The automatic umbrella control mechanism of claim 1 wherein said receptacle comprises a rib coupled to the longitudinal sliding groove inside said socket to guide vertical movement of said receptacle in said socket, a pressure strip disposed at one side opposite to said rib, and a rectangular top notch corresponding to said pressure strip.

* * * * *